United States Patent [19]

Gendron

[11] Patent Number: 4,730,767

[45] Date of Patent: Mar. 15, 1988

[54] LETTER SHEET WITH RETURN ENVELOPE

[75] Inventor: Wilfred H. Gendron, Wilbraham, Mass.

[73] Assignee: Westvaco Corporation, New York, N.Y.

[21] Appl. No.: 847,530

[22] Filed: Apr. 30, 1986

[51] Int. Cl.[4] ..... B65D 27/06

[52] U.S. Cl. ..... 229/73; 229/70

[58] Field of Search ..... 229/73, 69, 70, 75

[56] References Cited

U.S. PATENT DOCUMENTS 3,802,618 4/1974 Wiessner ..... 229/71
3,833,167 9/1974 Kapitan ..... 229/73
4,047,661 9/1977 Klein ..... 229/70
4,487,360 12/1984 Fisher et al. ..... 229/73

*Primary Examiner*—Willis Little

[57] ABSTRACT

A personalized envelope assembly including a return envelope is formed from two separate pieces of material comprising an outer blank for forming a letter sheet or the like and a patch which is adhered to the blank to form the rear panel of the return envelope. The letter sheet blank is prepared in web form and the patch is applied to the blank using window applying equipment or the like. The letter sheet blank further includes one or more coupon elements integral therewith and detachable therefrom for return mail.

3 Claims, 9 Drawing Figures

LETTER SHEET WITH RETURN ENVELOPE

BACKGROUND OF INVENTION

The present invention relates to direct mail articles comprising an outer letter sheet or envelope which includes therein a preformed reply or return envelope and one or more detachable reply coupons as desired. The article and the method of manufacture is especially adapted to the personalization of the final product.

The method and product described herein is particularly suited for the commercial production of personalized articles in which the printed content is for the most part the same, but which may be readily personalized in prescribed areas during production for the intended recipient. Users of direct mail products regard personalization as a highly desirable feature. Letters of the type used in direct mail advertising, fund raising solicitation and the like are usually personalized by printing the name of the recipient in one or more places within the body of the product using a high speed computer printer or the like. When a return coupon or the like is included in the package, it is also desirable to imprint the name of the recipient thereon to assure proper identification of the returned item. Customarily such return pieces are separately printed and later collated with the corresponding letter pieces. However, errors in collation often occur when the return items are assembled with the letters to complete the mailing package. Accordingly, it is the general object of the present invention to provide an improved method for making a personalized letter package which includes an outer letter sheet or envelope, one or more detachable coupons integral therewith and a return envelope structure, using conventional equipment and a minimum amount of paper material.

SUMMARY OF INVENTION

In accordance with the present invention an improved method and product is disclosed. The product comprises a novel envelope assembly consisting of an outer letter sheet or envelope, one or more detachable coupons integral therewith, and a return envelope formed by a patch applied to the outer letter sheet or envelope blank. The package is personalized with the name of the recipient imprinted in one or more places on the body of the letter sheet or envelope and on its associated return item in a single computerized printing operation. Because the coupons are initially prepared as an integral part of the initial envelope structure, there is no possibility for mixing the items during the folding, gluing and assembly of the final product.

DETAILED DESCRIPTION

The envelope assembly of the present invention is illustrated and described herein in the form of a letter sheet. It will be understood by those skilled in the art that the product could readily take the form of an envelope if desired with the addition of suitable closures for the side edges. The envelope assembly in its entirety comprises a letter sheet, a return envelope portion and one or more detachable coupons or the like integral with the letter sheet component. The return envelope portion is formed with the application of a patch to one of the panels of the letter sheet. It will be understood by those skilled in the art that the patch element could readily be attached to the letter sheet panel by any well known means.

In a preferred embodiment of the present invention, the envelope assembly is prepared in-line from a roll of paper stock. The roll is unwound in web form and passed through a plurality of forming stations where the web is printed, scored, applied with adhesive, personalized, applied with a return envelope patch, separated into individual blanks, folded and sealed for mailing. In an alternative method the web would be pre-printed and personalized by a vendor and then converted separately for mailing. In yet another method the web could be initially personalized, and then printed and converted for mailing.

Figure 1A:
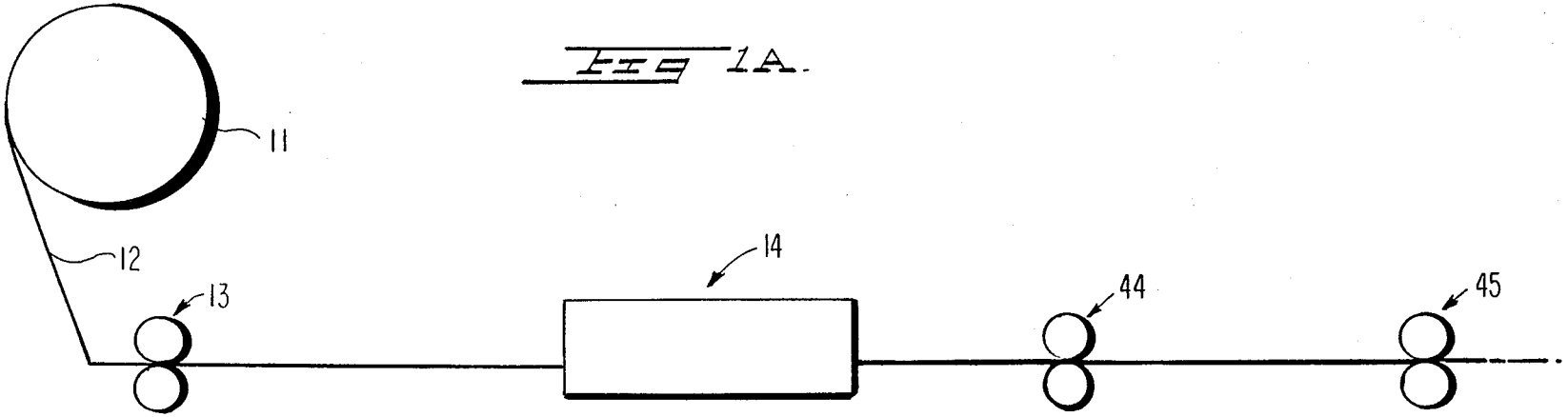
FIGS. 1A and 1B are schematic illustrations in elevation of an exemplary method for manufacturing the envelope assembly of the present invention.
Figure 2A:
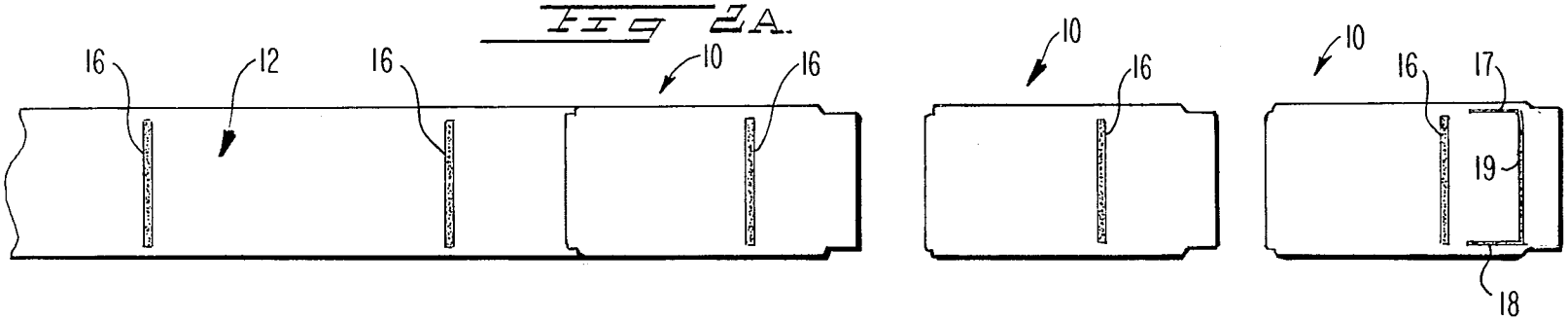
FIGS. 2A and 2B are schematic illustrations in plan of FIGS. 1A and 2B showing the formation of the envelope assembly.
Figure 1:
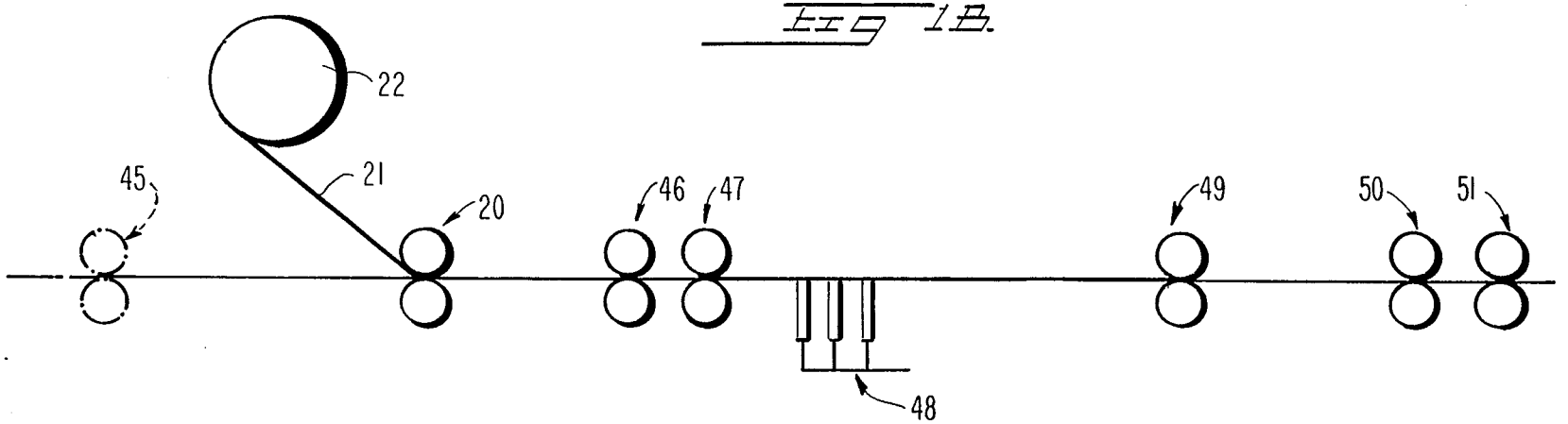
Figure 2:
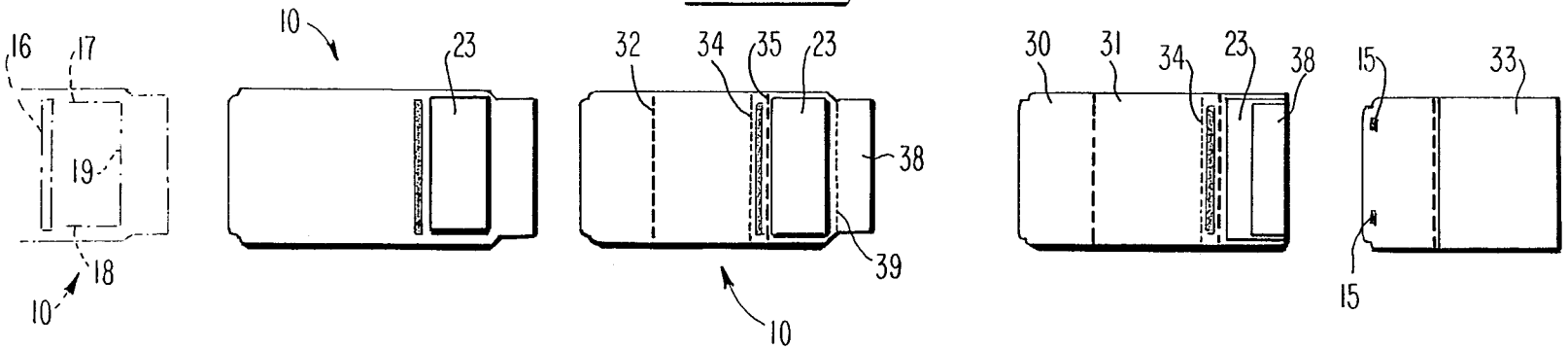

FIGS. 1A and 1B together show a schematic representation of the various converting steps. FIGS. 2A and 2B together show in plan the formation of the blank assembly. In the preferred method, the envelope assembly is prepared from a roll of envelope paper stock. The roll 11 is unwound in web form 12 and passed through forming steps which, for example, may comprise a first gumming station 13 where strips of adhesive 16 are applied and a cutting station 14 where the blank structure is formed. The adhesive strips are used to seal the return envelope structure and at the cutting station 14, waste material from the blank 10 is removed and discarded. After the blank cutting station 14, the web is passed through a printing step 44 where one or both sides of the blank 10 are printed with the desired graphics. The inner surfaces of the blank 10 provide space for messages, advertising information, promotional offers and other graphical material. At the same printing station 44 the return portion of the outer surface of the blank may be printed with the return name and address.

After the blank is printed, it may be passed through a second glue station 45 at which point patches of adhesive 17,18 and 19 are applied for gluing the patch element 23 to the envelope blank 10. The patch material 21 is provided in roll form 22 and is applied to the blank 10 at a patching station 20. After the blank is patched the blank 10 proceeds through a scoring station 46 where the score lines 32,35 and 39 are applied. These score lines divide the blank 10 into its different panels and its coupon element 38. After being scored, the blank 10 may be passed through a perforation station 47 where the perforation line 34 is applied. The perforation line 34 divides the blank 10 at the point where the return envelope structure may be separated. Obviously, the scoring and perforation steps could clearly be done at other points in the process. After the blank is patched, scored and perforated it is passed through a second printing station 48 where the envelope assembly is personalized. At station 48 all of the panels of the blank 10 which are to receive their personalized identification are printed. This step eliminates any errors in collation of the return pieces (coupons).

After being personalized the blank is essentially finished and ready to be prepared for mailing. For this purpose, the blank may be folded initially at a folding station 49 prior to the application of gum 15 on the first closure flap at station 50, and then folded into its final mailing shape at folding station 51.

Figure 3:
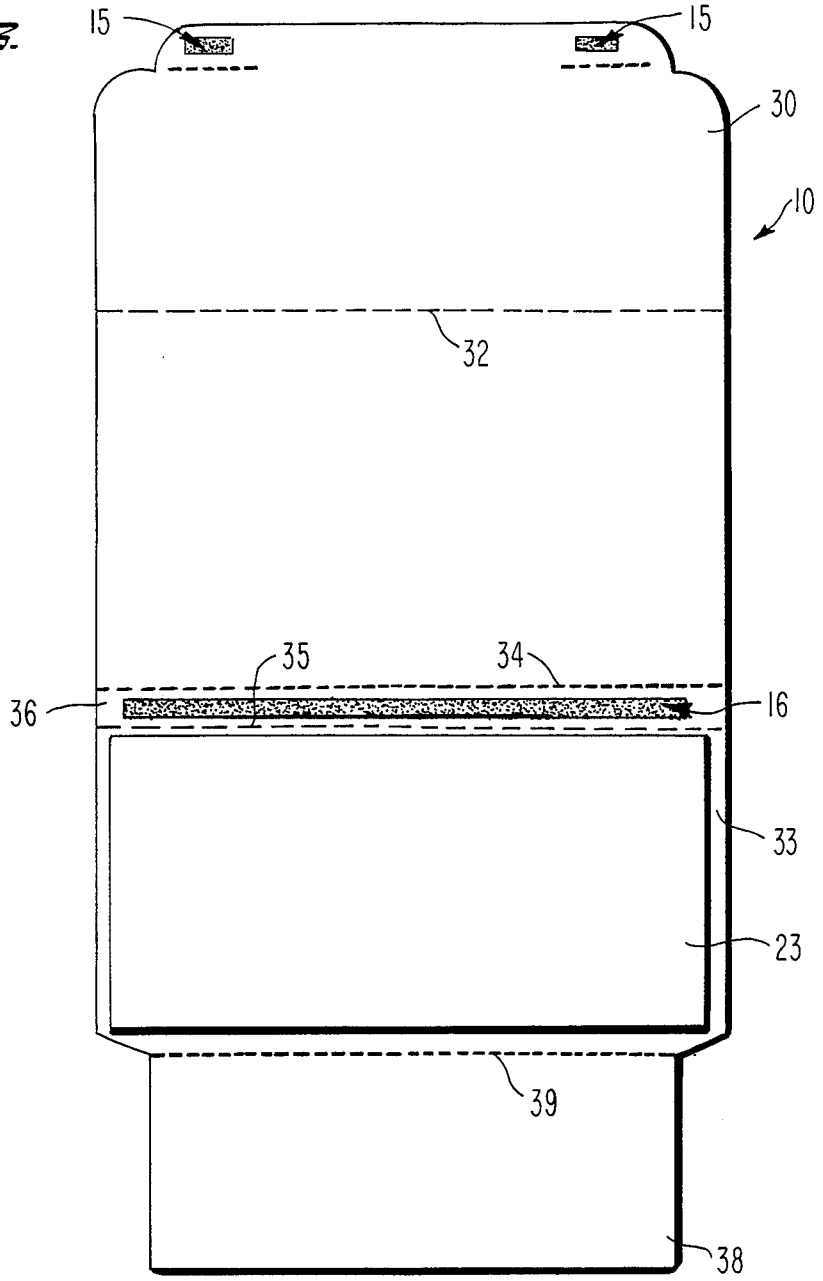
FIG. 3 is a plan view of the completed envelope assembly blank.

FIG. 3 illustrates a preferred embodiment of the letter sheet described herein. The blank 10 comprises a closure flap 30 to which spots of adhesive 15,15 have been preapplied. The closure flap 30 is foldably attached to one edge of a front panel 31 along a score line 32. The front panel 31 is in turn detachably secured to one edge of a rear panel 33 along a perforated line 34. The rear panel 33 contains a scored fold line 35 spaced from perforated line 34 a sufficient distance to permit application of the adhesive strip 16 and to form the return envelope closure flap. The blank material 36 located between perforated line 34 and fold line 35 becomes the closure flap for the return envelope portion 37. The construction of the return envelope portion 37 is completed by application of the patch element 23 as aforesaid and the letter sheet blank 10 is finally provided with one or more coupon elements 38 which are detachably secured to an edge of the rear panel 33 along a perforated line 39.

The envelope assembly of the present invention may thus be seen to comprise a main envelope or letter sheet (as shown) and a return envelope structure prepared from a primary envelope blank and a patch element. The product is prepared from two continuously moving webs of sheet material using for example the window application equipment normally used to apply window film to windowed envelopes. The envelope assembly further includes a provision for the addition of return coupon elements or the like in conjunction with the basic envelope structure. In this manner the envelope assembly is readily capable of being personalized back and front using high speed computer operated printing equipment.

Figure 4:
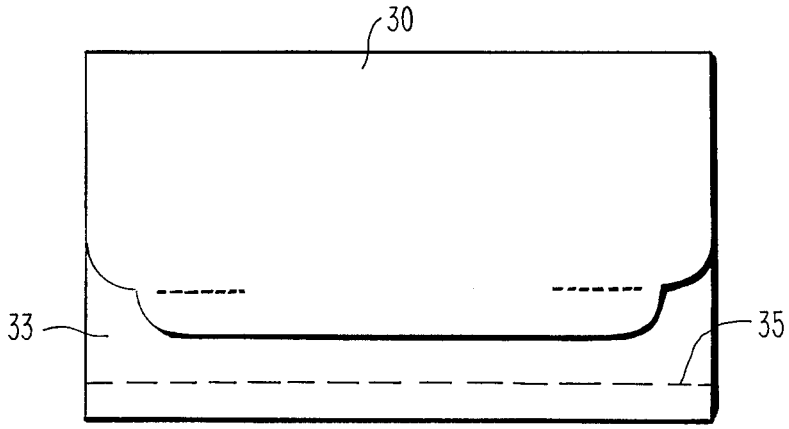
FIG. 4 is a plan view of the envelope folded and sealed for initial delivery.
Figure 5:
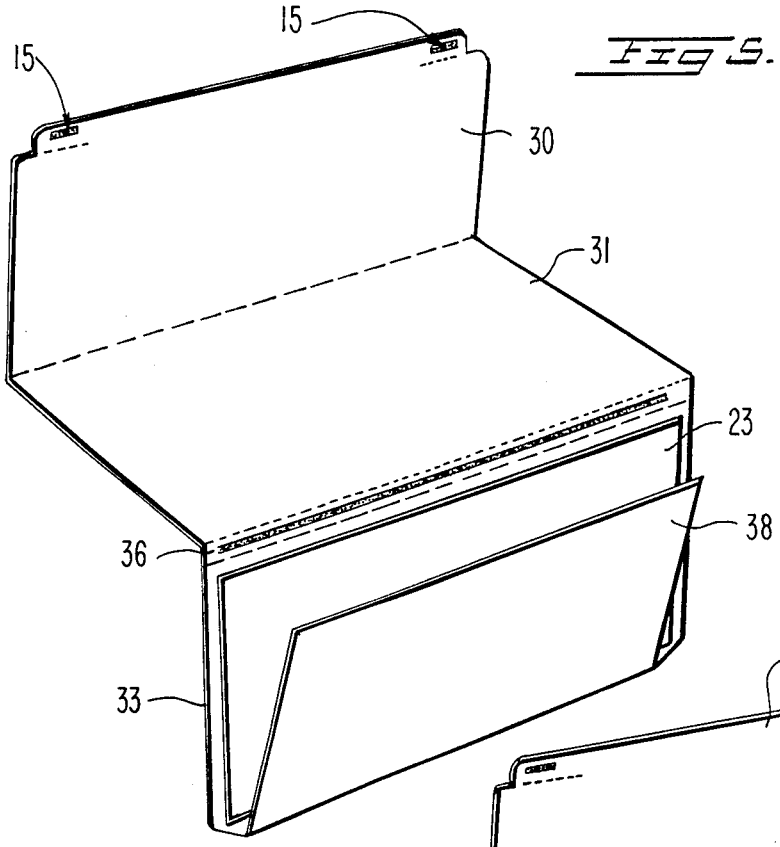
FIG. 5 is a perspective view of the envelope assembly as received and in opened condition.

FIG. 4 illustrates the envelope assembly 10 shown in FIG. 3 folded and sealed for the initial mailing. The rear panel 33 of the letter sheet/envelope is shown in FIG. 4 with it being understood that the accompanying front panel 31 (not shown) has been pre-printed and personalized with the recipients name and address. After receipt by the recipient, the letter sheet/envelope is opened by separating the closure flap 30 at adhesive spots 15 from the rear panel 33. The entire structure is opened up as shown in FIG. 5 to make available the coupon element 38 and to expose the graphic materials preprinted on the inner surfaces of closure flap 30 and front panel 31.

Figure 6:
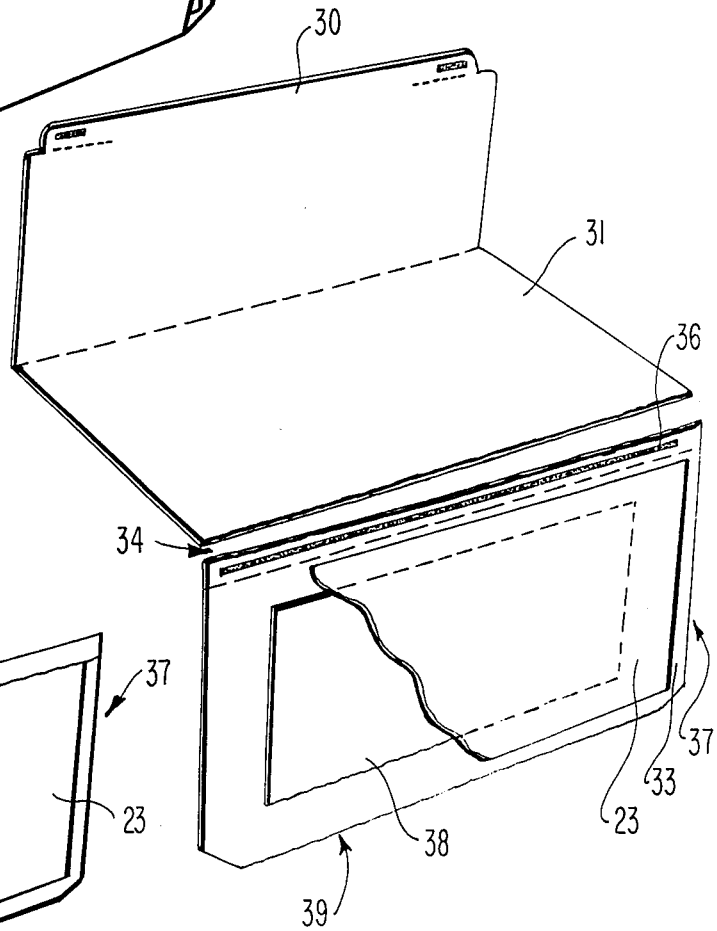
FIG. 6 is a perspective view of the envelope assembly of the present invention with sections detached to reveal the return envelope portion.
Figure 7:
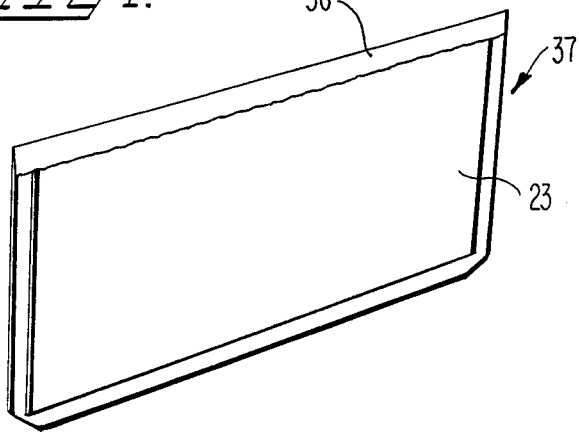
FIG. 7 is a perspective view of the return envelope sealed for return delivery.

The envelope structure is next prepared for return by separating the closure flap 30 and front panel 31 from the return envelope closure flap 36 along the perforated line 34 as shown in FIG. 6. At the same time, the coupon element 38 may be detached from the rear panel 33 along perforated line 39 and inserted in the pocket of the return envelope created by the rear panel 33 and patch element 23 as shown in FIG. 6. In this regard it will be noted that the rear panel 33 of the outgoing letter sheet/envelope generally becomes the front panel of the return envelope since it is preferably pre-printed with the return address of the original sender. Finally FIG. 7 shows the return envelope 37 sealed and prepared for return.

While the foregoing specification, drawing and detailed description illustrate and describe only one embodiment of the present invention, it will be understood by those skilled in the art that variations and modifications may be made without departing from the spirit and scope of the appended claims.

What is claimed is:

1. An envelope assembly prepared from two separate blanks of envelope material comprising a first blank of envelope material having inner and outer surfaces which is cut and scored to provide a first mailing piece consisting of four interconnected elements, said elements including front and rear panels, a first closure flap and an integral return coupon, and a second blank of envelope material having four edges that is adhered along at least three of its edges to the inner surface of the rear panel of said first blank to form an enclosed pocket between the second blank and the rear panel for return mailing, said coupon being attached to one edge of said rear panel along a first perforated line and said front panel being attached to an opposite edge of said rear panel along a second perforated line.

2. The envelope assembly of claim 1 wherein said rear panel includes a fold line adjacent to and parallel to said second perforated line offset slightly from the unadhered edge of said second blank.

3. The envelope assembly of claim 2 wherein a line of adhesive is applied to the return panel between said second perforated line and the fold line adjacent thereto.

* * * * *